US005392819A

United States Patent [19]

Lin

[11] Patent Number: 5,392,819

[45] Date of Patent: Feb. 28, 1995

[54] PLANETARY GEAR TYPE SELVAGE FORMING AND CORD CATCHING DEVICE FOR LOOM

[75] Inventor: Chun-Yen Lin, Tainan, Taiwan, Prov. of China

[73] Assignee: Hunshin Enterprise Co., Ltd., Tainan Hsien, Taiwan, Prov. of China

[21] Appl. No.: 164,538

[22] Filed: Dec. 10, 1993

[51] Int. Cl.[6] ..... D03D 47/40; D03C 7/08

[52] U.S. Cl. ..... 139/430; 139/370.2; 139/450; 139/302; 139/54

[58] Field of Search ..... 139/370.2, 430, 302, 139/54, 450, 303

[56] References Cited

U.S. PATENT DOCUMENTS

| | | | |
|---|---|---|---|
| 3,181,568 | 5/1965 | Dewas | 139/430 |
| 4,103,714 | 8/1978 | Hasebe | 139/430 |
| 4,580,605 | 4/1986 | Gosciniak et al. | 139/430 |

*Primary Examiner*—Andrew M. Falik

*Attorney, Agent, or Firm*—Morton J. Rosenberg; David I. Klein

[57] ABSTRACT

A selvage forming and cord catching device for use in a loom includes a base adapted to be secured to the loom and has two planetary gear systems mounted on it. Each of the planetary gear systems has two planetary gears orbiting about a central axis. A cylindrical yarn guide member is secured at the center of each of the planetary gears to allow yarn to extend through the center of each of the planetary gears. The yarn is brought through a guide arm mounted on each of the planetary gears in an eccentric manner so that when the planetary gears rotate, the yarn passing out of each of the planetary gears of each of the planetary gear systems are fed to the loom in an inter-crossing and inter-winding manner to wind around each other. The yarn from one of the planetary gear systems is fed to the loom to form the selvage. The yarn from the other one of the planetary gear systems is brought to a particular position to pinch therebetween the excessive length of the wefts and carry away the excessive length of the wefts after such is cut by scissors.

9 Claims, 8 Drawing Sheets

PLANETARY GEAR TYPE SELVAGE FORMING AND CORD CATCHING DEVICE FOR LOOM

FIELD OF THE INVENTION

The present invention relates to a loom and in particular to a selvage forming and cord catching device for a loom.

BACKGROUND OF THE INVENTION

Fabrics are generally formed by weaving warps and wefts in a crossing and inter-overlapping manner. In an automatic loom, warps are moved up and down by mechanism driven by motors to allow wefts which are moved by suitable means, such as pressurized fluid, to extend through between the warps to cross and overlap the warps for the formation of the fabric. A selvage is required to form along the longitudinal edge of the fabric to avoid the yarns (warps and wefts) from loosening from the fabric. Thus, in an automatic loom, selvage forming device is required for the formation of the fabric.

Further, since the wefts used to form the fabric usually have a length greater than the span of the fabric, the excessive length of the wefts should be cut and separated from the fabric. Thus, a cord catching device for catching and removing the excessive length of the wefts from the finished fabric should be devised to improve the manufacturing of the fabric.

Conventional automatic looms usually comprise a selvage forming device as shown in FIG. 8. The conventional selvage forming device comprises a toothed wheel D on which two yarn reels with yarn wound thereon, designated with the reference F, are eccentrically mounted. The yarns extend out from the reels F through guide arms F1 mounted on the reels F or the toothed wheel D so that by the rotation of the toothed wheel D, the yarns from the two reels F are fed to the loom in an inter-crossing manner so as to form the selvage. The disadvantage is that due to the direct mounting of the yarn reels F on the toothed wheel D, the rapid rotation of the toothed wheel D causes vibration of the reels F and this may make the reels F get loose from the toothed wheel D after a long time operation.

On the other hand, the conventional cord catching device usually comprises a rotating member to wind or entangle a plurality of yarns together with the excessive length of the wefts to be cut pinched between the yarns to form a "rope" so as to remove the wefts that are cut from the fabric. Since the yarns are only rotated at one end thereof, the pinching effect may not be adequate and as a remedy, more yarns should be used to more firmly pinch the wefts to be cut. This causes a waste of yarns.

SUMMARY OF THE INVENTION

An objective of the present invention is to provide a selvage forming device wherein the yarn reels are not mounted on moving parts and instead, are fixed so as to avoid the above-mentioned deficiency.

It is another objective of the present invention to provide a cord catching device which uses only two yarns to catch the wefts to be cut from the finished fabric.

It is a further objective of the present invention to provide a selvage forming and cord catching device which overcomes the deficiencies of the conventional devices used in the automatic loom.

To achieve the above objective, there is provided a selvage forming and cord catching device for use in a loom comprising a base on which two planetary gear systems are mounted. Each of the planetary gear systems has two planetary gears orbiting about a central axis. A cylindrical yarn guide member is secured on the center of each of the planetary gears to allow a yarn to extend through the center of the planetary gear. The yarns are further conducted through a guide arm mounted on each of the planetary gears in an eccentric manner so that when the planetary gears rotate, the two yarns come out of the planetary gears of each of planetary systems are fed to the loom in an inter-crossing and inter-winding manner to wind with each other. The yarns from one of the planetary gear systems are fed to the loom to form the selvage. The yarns from the other one of the planetary gear system are conducted to a suitable position to pinch therebetween the excessive length of the wefts and carry away the excessive length of the wefts after it is cut by scissors.

BRIEF DESCRIPTION OF THE DRAWINGS

The present invention will be better understood from the following description of a preferred embodiment thereof, with reference to the drawings, wherein.

DETAILED DESCRIPTION OF THE PREFERRED EMBODIMENT

Figure 1:
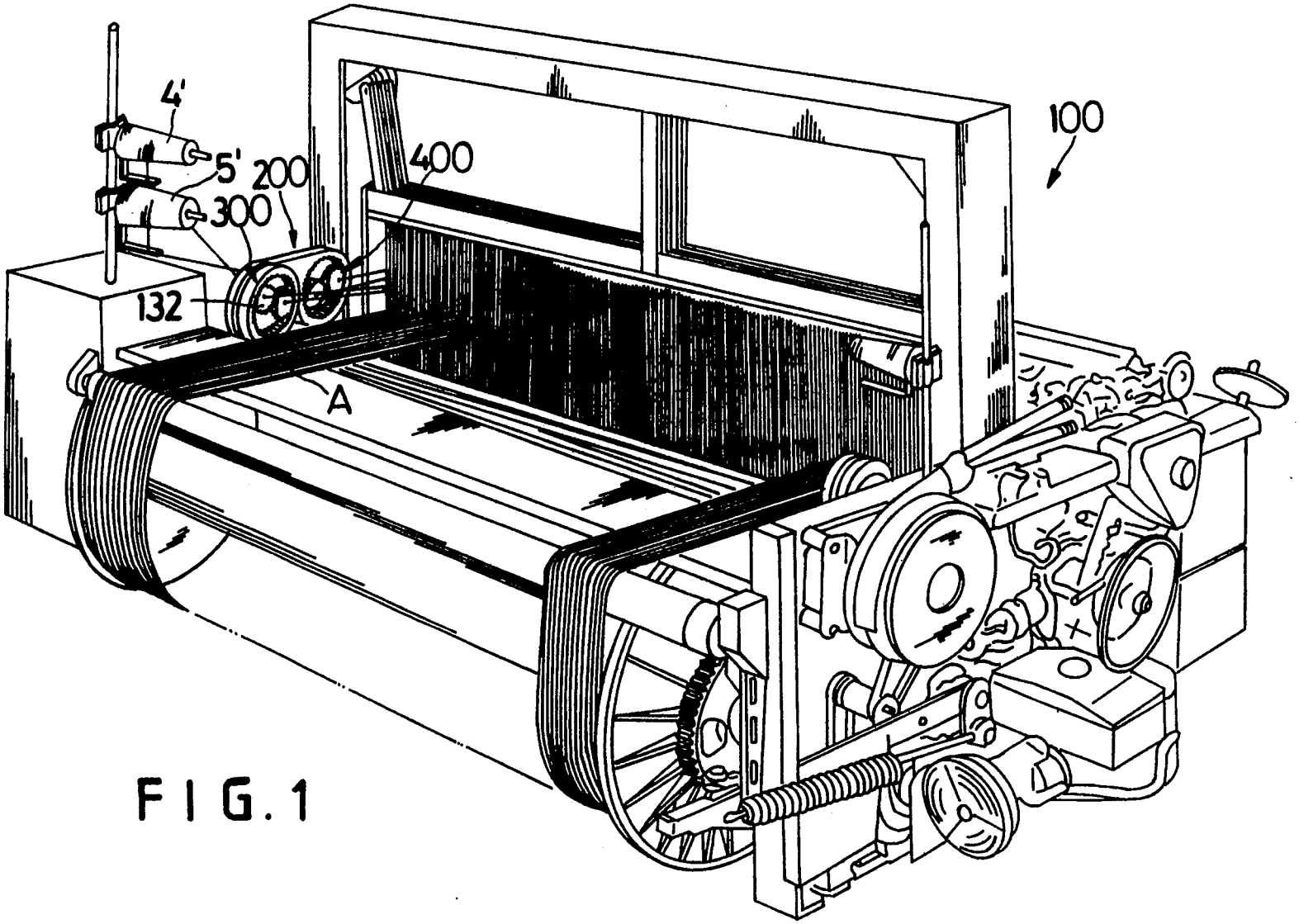
FIG. 1 is a perspective view showing a loom which incorporates a selvage forming and cord catching device constructed in accordance with the present invention.

With reference to the drawings and in particular FIG. 1, wherein a loom, designated with the reference numeral 100, incorporates a selvage forming and cord catching device constructed in accordance with the present invention, generally designated with the reference numeral 200, is shown, the selvage forming and cord catching device 200 is devised for forming a selvage C1 (see FIG. 7) on a fabric C woven with warps A and wefts B (see FIG. 6) by the loom 100 and catching the discarded cords resulted from cutting the excessive length of the wefts B in the formation of the selvage C1.

Further referring to FIGS. 2–5, wherein an embodiment of the selvage forming and cord catching device 200 of the present invention is shown, the selvage forming and cord catching device 200 comprises a base 1 which has a rear gear seat 11 which comprises a circular recess 110 formed on the base 1 with a central through hole 115 formed therein and a front gear seat 12 which comprises a recess 120 formed on the base 1 with a central through hole 122 formed therein. A slot 114 is formed between the two recesses 110 and 120.

The rear gear seat 11 comprises a ring-like projection 116, concentric with the recess 110 and the hole 115, having an inner toothed section 111 formed therein to define a ring gear. A slot 113 is formed along the circumference of the ring-like projection 116.

A rear planetary gear train 400 is rotatably supported and retained within the rear gear seat 11. The rear gear seat 11 has a bearing race 112 formed inside the rear hole 115 within which a plurality of bearing balls 151 (see FIG. 4) are rollingly disposed. The rear planetary gear train 400 comprises a sun gear 14 which has a hub 144 extending from a first surface thereof to be received within the rear hole 115. The hub 144 has formed thereon an inner bearing race 147 corresponding to the outer race 112 to receive and retain the bearing balls 151 therebetween. The inner and out races 147 and 112 and the bearing balls 151 rollingly retained therebetween provides bearing means to rotatably support the rear sun gear 14 within the rear gear seat 11.

The rear planetary gear train 400 comprises two planetary gears 140 rotatably secured on a second surface of the rear sun gear 14 in an eccentric manner to be engageable with the ring gear 111 formed on the ring-like projection 116 of rear gear seat 11 so that by the rotation of the rear sun gear 14 and the engagement with the rear ring gear 111, the planetary gears 140 are rotated to orbit about a central axis of the rear sun gear 14.

The mounting of each of the rear planetary gears 140 to the rear sun gear 14 comprises an axle 1401 secured on and extending from the planetary gear 140. The axle 1401 is received within a hole 1403 formed on the rear sun 14 and is rotatably supported by bearing means 145. Preferably, the axle 1401 has a threaded end 1404 projecting out of the hub 144 of the rear sun gear 14 to be engaged by a nut member 146 so as to secure the axle 1401 on the rear sun gear 14.

The axle 1401 has a through hole formed thereon with a cylindrical yarn guide member 1402 inserted therein. The yarn guide member 1402 defines a passage for a yarn 310 or 4 to pass therethrough.

To actuate the rear planetary gear train 400, a driving gear 2 which is driven by a motion transmission system (not shown) of the loom 100 is disposed to have a portion thereof extending through the circumferential slot 113 of the ring-like projection 116 to engage the rear sun gear 144. Since the transmission system which transmits rotation to the driving gear 2 is not the concern of the present invention and since such a motion transmission system is well known to those having ordinary skill in mechanical transmission, no detail regarding the transmission system will be given hereinafter.

Figure 2:
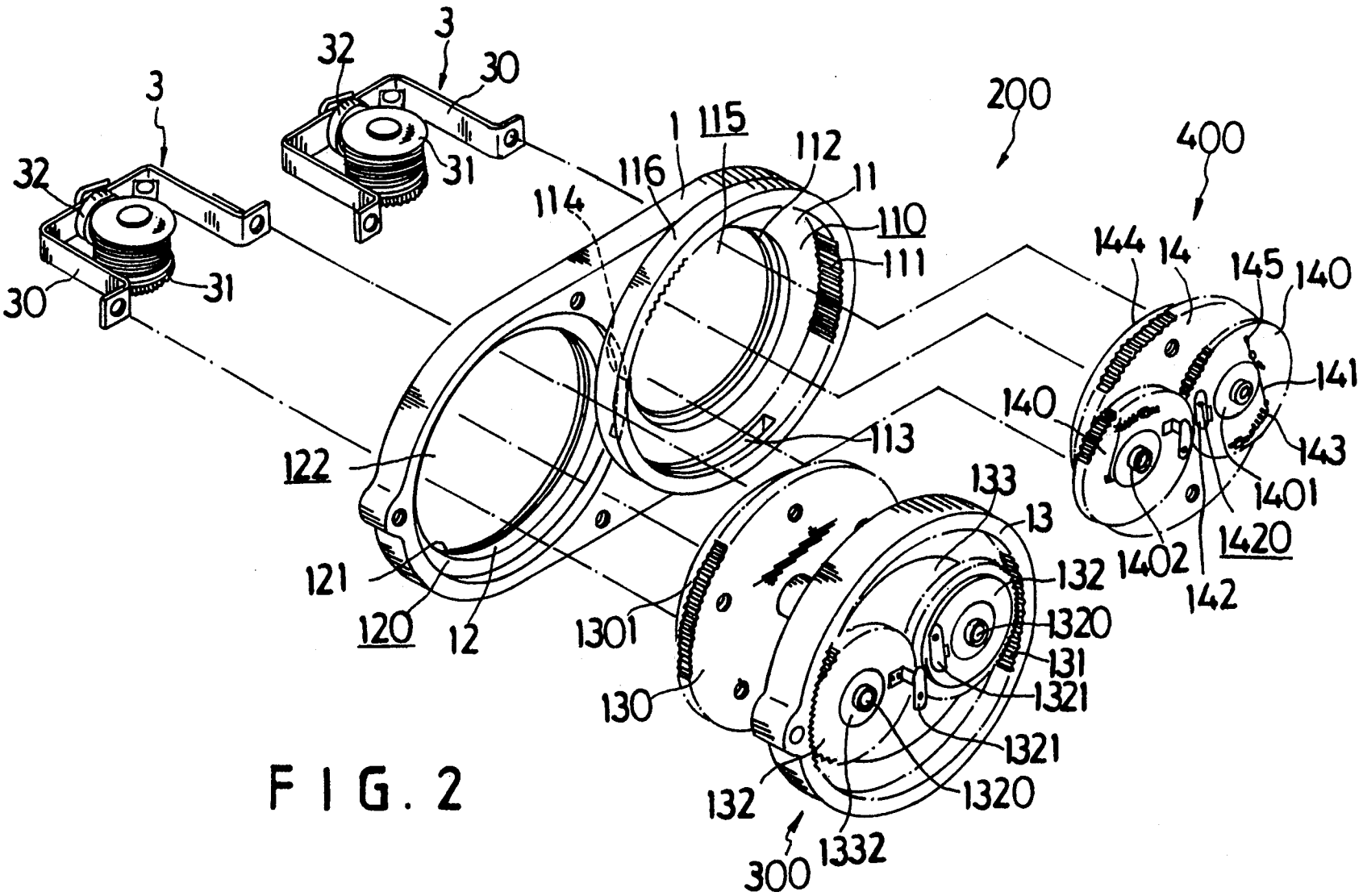
FIG. 2 is an exploded perspective view showing the selvage forming and cord catching device of the present invention.
Figure 3:
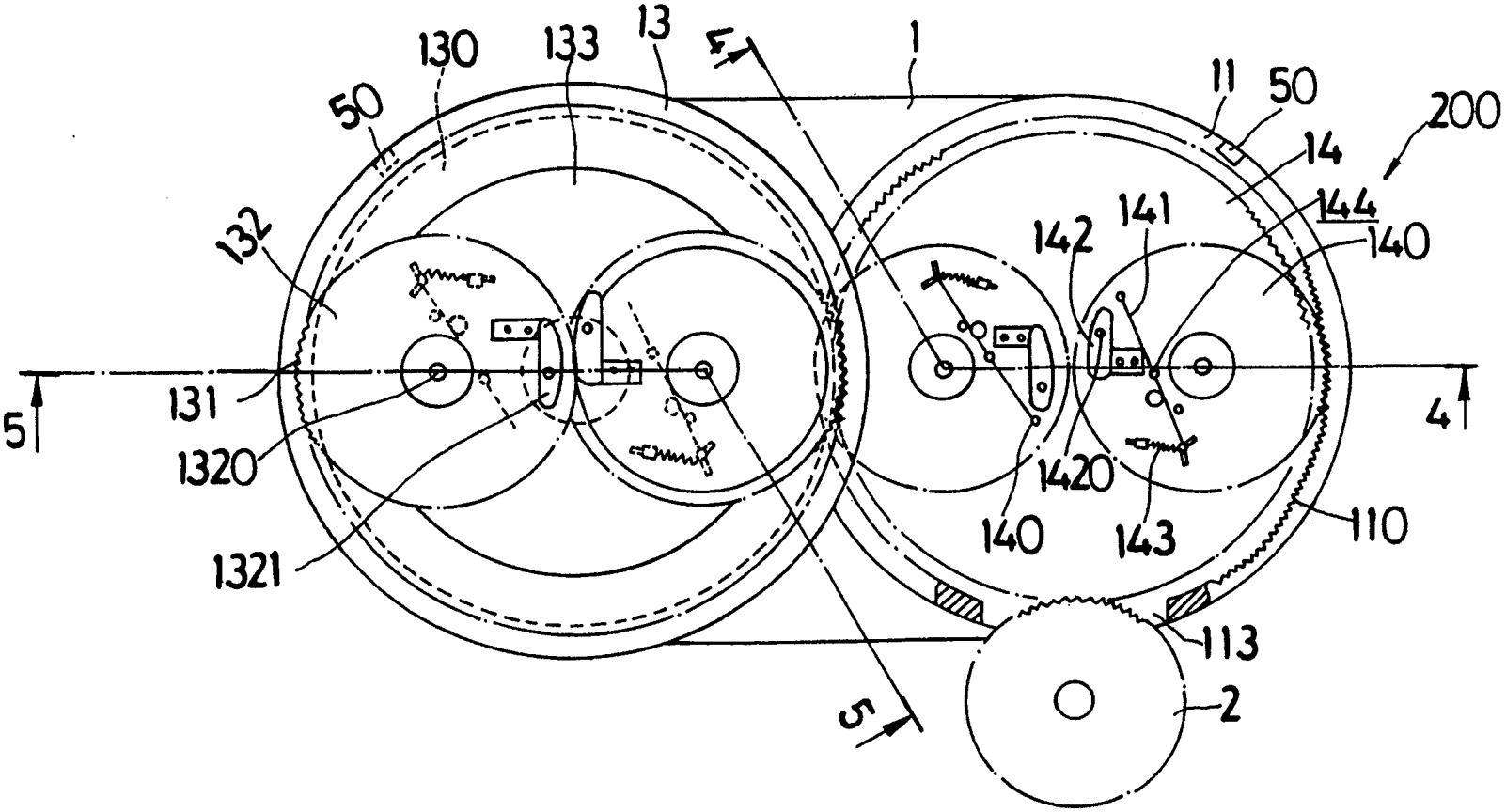
FIG. 3 is a side elevational view showing the selvage forming and cord catching device of the present invention.
Figure 4:
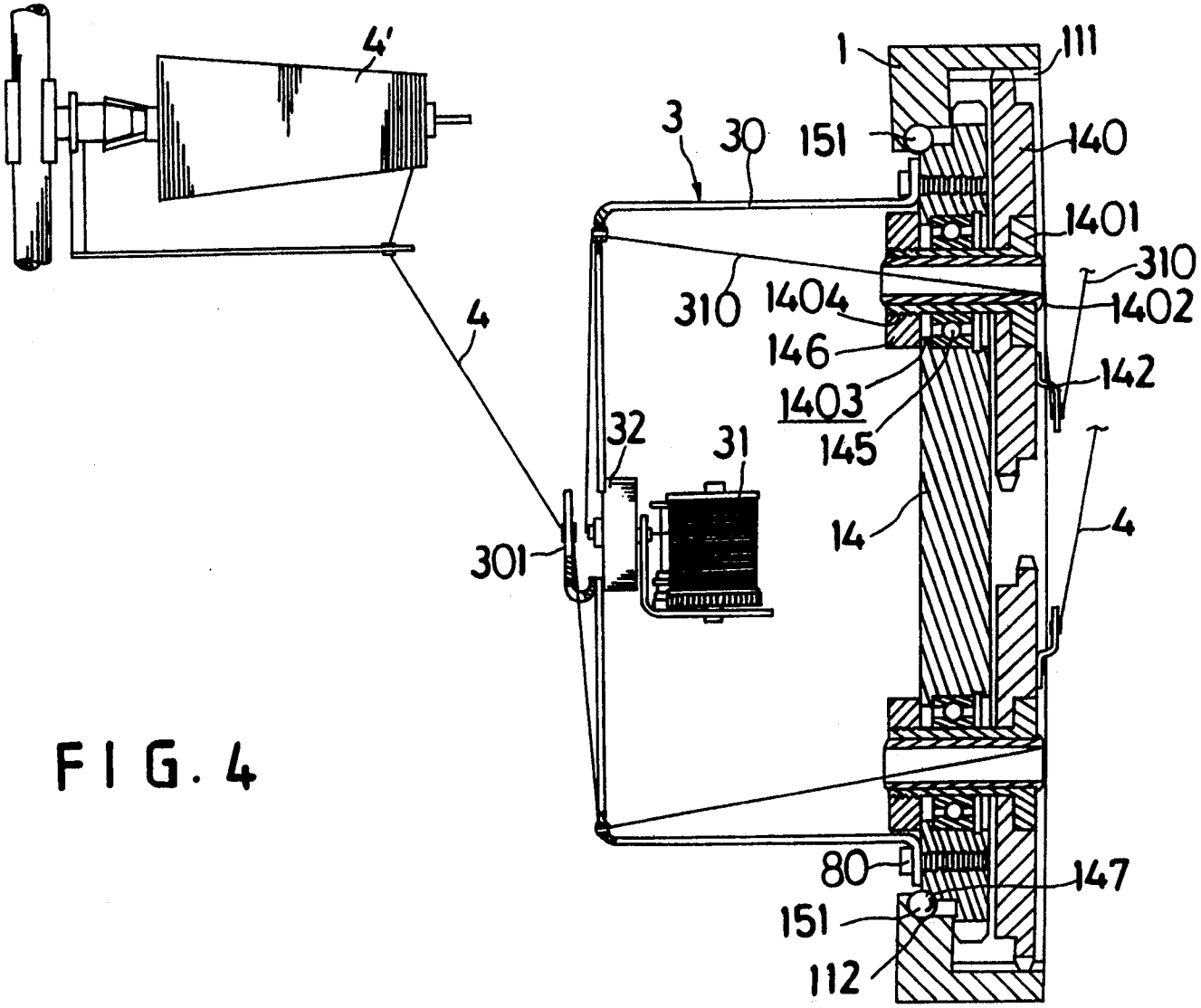
FIG. 4 is a cross-sectional view of the selvage forming and cord catching device of the present invention taken along line 4—4 of FIG. 3.
Figure 5:
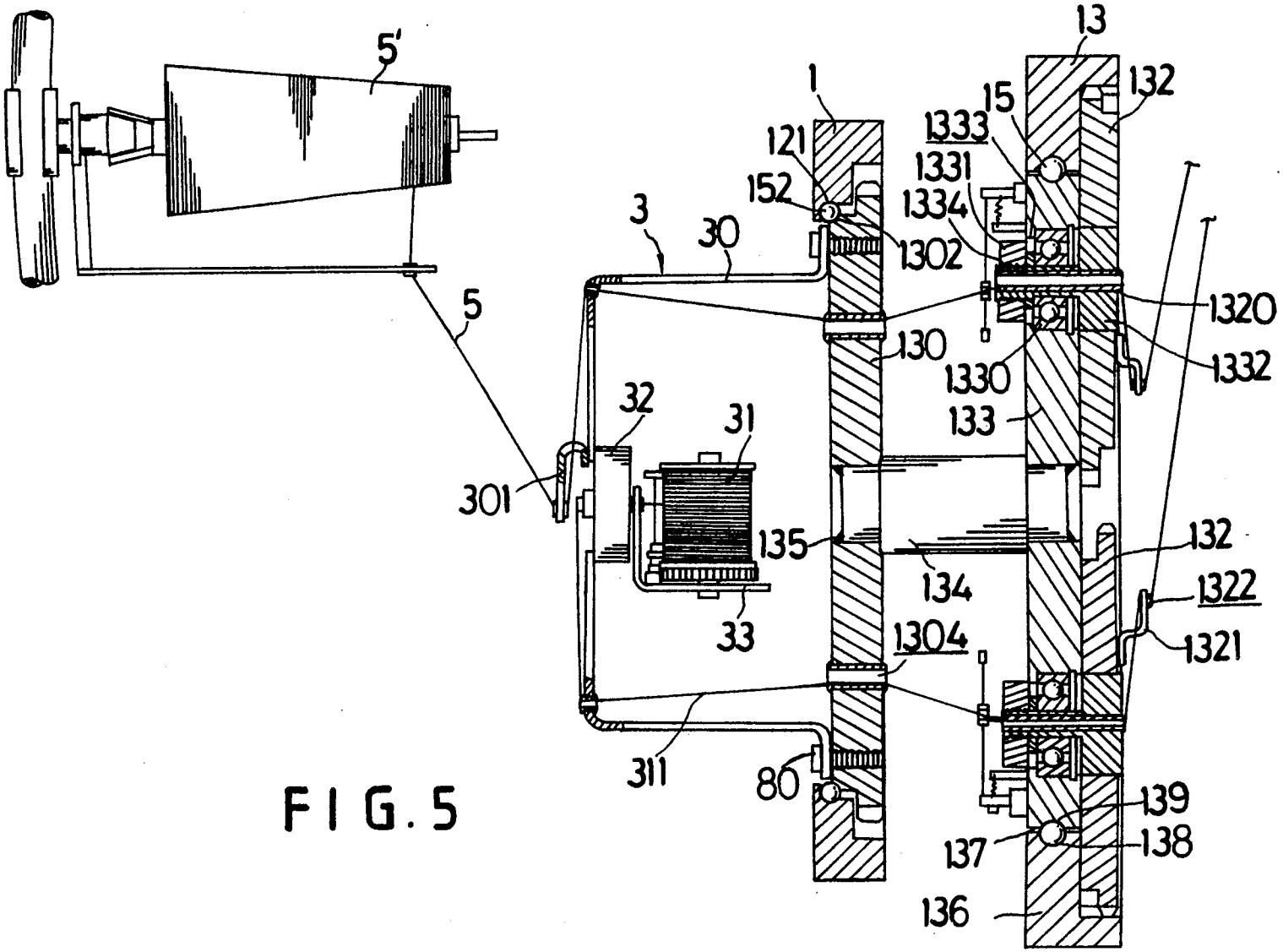
FIG. 5 is a cross-sectional view of the selvage forming and cord catching device of the present invention taken along line 5—5 of FIG. 3.

Now referring to FIGS. 2, 3 and 5, the front gear seat 12 has received therein a front gear 130 which has a hub 1301 extending from a first surface thereof to be rotatably received within the front hole 122. The front hole 122 comprises a bearing race 121 formed on the periphery thereof. A corresponding inner race 1302 is formed on the hub 1301. A plurality of bearing balls 152 are disposed and retained between the outer and inner races 121 and 1302 to rotatably support the front gear 130 within the front gear seat 12.

The front gear 130 has connected thereto a front planetary gear train 300 wherein the front gear 130 serves as the sun gear and thus the front gear 130 will be also referred as the front sun gear 130 herein. The front planetary gear train 300 comprises a ring gear 13 with two planetary gears 132 disposed therein to be engageable therewith. The front ring gear 13 is fixed on the base 1, for example by screws (not shown).

As shown in FIG. 5, a circular disk member 133 is concentrically secured to the front sun gear 130 by a rod 134 to be rotatable in unison therewith. The rod 134 is securely mounted to both the front sun gear 130 and the disk 133 preferably by welding 135 or other known fastening means, such as threading.

Both the front ring gear 13 and the front planetary gears 132 are rotatably supported on the disk member 133 by bearing means 153 and 1330. Each of the front planetary gears 132 has an axle 1332 concentrically extending therefrom to be received and rotatably supported within a hole 1333 formed on the disk member 133 by the bearing means 1330. Preferably, the axle 1332 has a threaded end 1334 projecting out of the disk member 133 to be engaged by a nut 1331 so as to secure the axle 1332 and thus the planetary gear 132 on the disk member 133.

Each of the front axles 1332 has a concentric cylindrical yarn guide member 1320 extending therethrough. The yarn guide members 1320 define passages for yarns 311 and 5 to pass therethrough.

The front ring gear 13 comprises an inner flange or bottom 136 defining a central hole 137 thereof within which the disk member 133 is so disposed to have the front planetary gears 132 engageable with the front ring gear 13. The inner flange 136 of the ring gear 13 has an outer bearing race 138 formed thereon and a corresponding inner bearing race 139 is formed around the disk member 133 to receive and retain therebetween a plurality of bearing balls 153 to rotatably support the disk member 133 on the front ring gear 13.

The front sun gear 130 is provided with a plurality of through holes 1304 corresponding to the cylindrical yarn guide members 1320 to allow yarns 5 and 311 to extend therethrough to the cylindrical yarn guide members 1320.

The front sun gear 130 is disposed within the front gear seat 12 to have a portion thereof extend through the slot 114 formed between the front and rear gear seats 12 and 11 to engage the rear sun gear 14 of the rear planetary gear train 400 so as to be driven by the rotation of the rear sun gear 14 of the rear planetary gear train 400 which is in turn driven by the driving gear 2 as discussed previously.

The rotation of the front sun gear 130 rotates the disk member 133 about a central axis thereof. This actuates the front planetary gears 132 to rotate its own axis by the engagement thereof with the ring gear 13 and thus orbit about the central axis of the front sun gear 130.

Both the front gear seat 12 and the rear gear seat 11 have yarn supply means 3 associated therewith. The yarn supply means 3 comprises a frame 30 which is preferably a U-shaped member secured to the front sun gear 130 (FIG. 5) or the rear sun gear 14 (FIG. 4) by fastener means, such as screws 80. A yarn reel support member 33 on which a yarn reel 31 is rotatably secured is rotatably secured to the U-shaped frame 30 via a bearing 32 so that the yarn reel 31 is rotatable relative to the front or rear sun gear 130 or 14 to substantially maintain stationary by gravity when the sun gear 130 or 14 is rotating. The yarn reel 31 has a first yarn 310 (FIG. 4) or 311 (FIG. 5) wound thereon to be unwound therefrom and supplied to the selvage forming and cord catching device 200 of the present invention.

As is known to those skilled in the art, the yarn reels 31 may comprise yarn tension control means which is constituted by ratchet mechanism (not shown) so as to maintain a constant tension on the yarns 310 and 311 supplied from the yarn reels 31.

The yarn supply means 3 further comprises a yarn guide arm 301 mounted on the U-shaped frame 30 to receive and escort a second yarn 4 (FIG. 4) or 5 (FIG. 5) supplied from a yarn bobbin 4' or 5' to the yarn supply means 3 to be further escorted to the selvage forming and cord catching device 200.

The first yarn 311 that is supplied from the yarn reel 31 associated with the front planetary gear system 300 is escorted through the cylindrical yarn guide members 1320 mounted on one of the front planetary gears 132 (FIG. 5). The first yarn 311 is then escorted to an arm 1321 fixed on the front planetary gear 132 to extend out therefrom through an eyelet 1322 formed on the arm 1321.

The second yarn 5 associated with the front planetary gear system 300 is conducted through the cylindrical yarn guide members 1320 of the other one of the front planetary gears 132 to an arm 1321 fixed on the front planetary gear 132 to extend out therefrom through an eyelet 1322 formed on the arm 1321.

Figure 6:
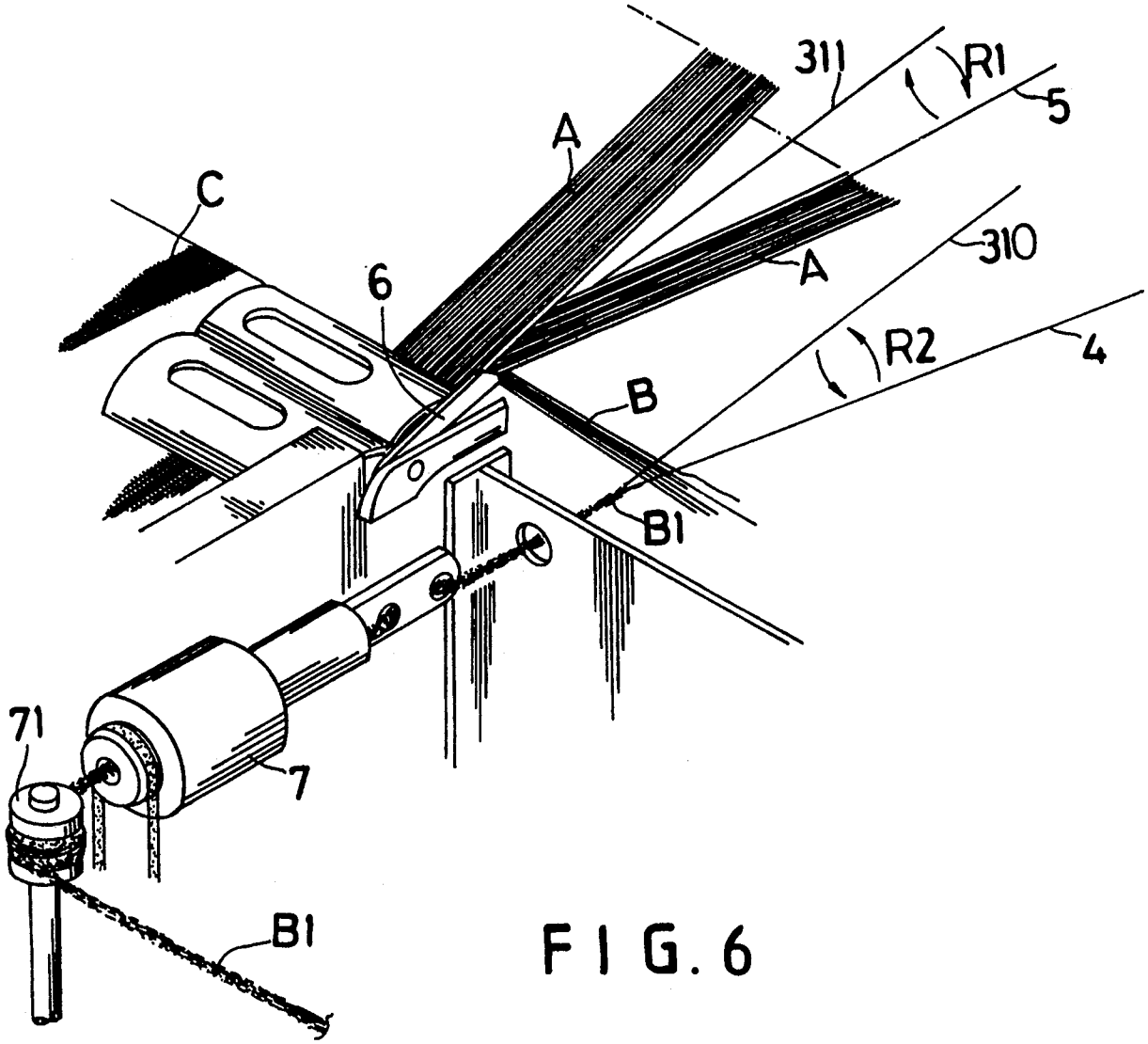
FIG. 6 is a perspective view showing the catching the wefts to be cut from the fabric.
Figure 7:
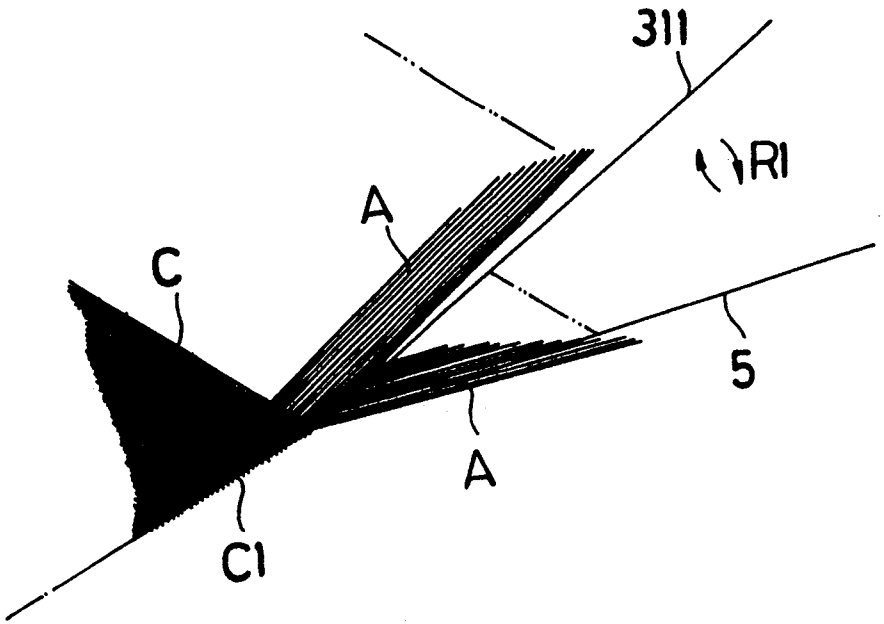
FIG. 7 is a perspective view showing the forming of the selvage of the fabric.
Figure 8:
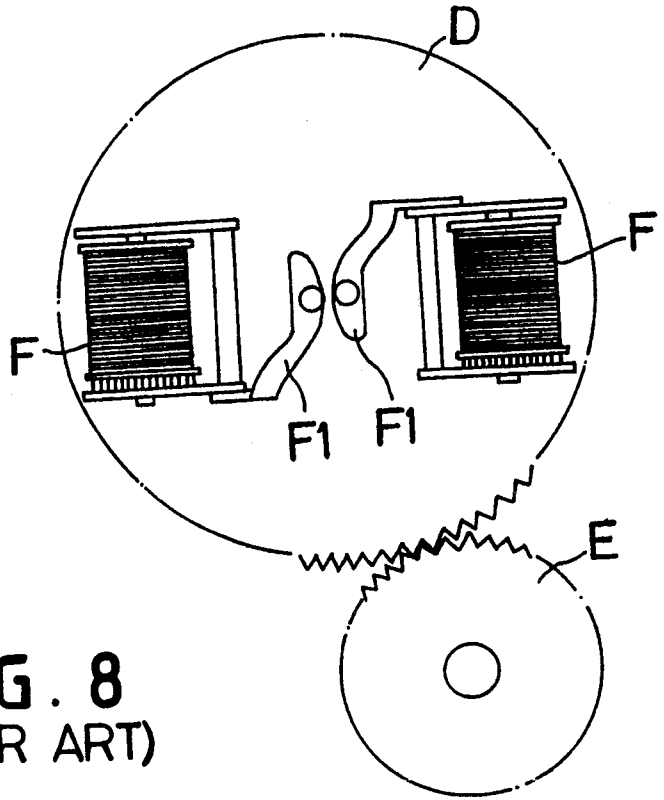
FIG. 8 (PRIOR ART)
FIG. 8 is a plan view showing a conventional selvage forming device.

With the rotation of the front planetary gears 132 by being driven by the front sun gear 130 and the disk member 133, the first yarn 311 and the second yarn 5 associated with the front planetary gear system 300 are fed to the loom 100 in an inter-crossing and inter-winding manner, as indicated by the arrows R1 of FIGS. 6 and 7 to form the selvage C1.

The selvage C1 is formed by having each of the wefts B extend through between the two yarns 5 and 311 which have inter-wound with each other at a first location before the weft B by the rotation of the front planetary gears 132. The yarns 5 and 311 are then inter-wound again at a second location after the weft B by the rotation of the front planetary gears 132 so as to pinch the weft B between the yarns 5 and 311 and thus forming the selvage C1 to securely hold the wefts B and the warps A.

Preferably, the front planetary gears 132 are so configured and disposed within the front ring gear 13 that when the front planetary gears 132 are rotated to be located in a first diameter of the front ring gear 13 which is preferably a horizontal diameter of the front ring gear 13 as viewed in FIG. 1 and which is the diameter passing through the centers of both the front and the rear holes 115 and 122, the arms 1321 thereof "meet" or come across each other at the center of the front ring gear 13, as shown in FIG. 2, and when the front planetary gears 132 are rotated to be located in a second diameter of the front ring gear 13, normal to the first diameter, which second-diameter is preferably a vertical diameter of the front ring gear 13 as viewed in FIG. 1, the arms 1321 thereof are respectively located at the topmost and lowermost positions of the front ring gear 13.

Similarly, the first yarn 310 that is supplied from the yarn reel 31 associated with the rear planetary gear system 400 is escorted through the cylindrical yarn guide member 1402 mounted on one of the rear planetary gears 140. The first yarn 310 is then escorted to an arm 142 fixed on the rear planetary gear 140 to extend out therefrom through an eyelet 1420 formed on the arm 142.

The second yarn 4 associated with the rear planetary gear system 400 is conducted through the cylindrical yarn guide member 1402 of the other one of the rear planetary gears 140 to an arm 142 fixed on the rear planetary gear 140 to extend out therefrom through an eyelet 1420 formed on the arm 142.

With the rotation of the rear planetary gears 140 by being driven by the rear sun gear 14, the first yarn 310 and the second yarn 4 associated with the rear planetary gear system 400 are fed to the loom 100 in an inter-crossing and inter-winding manner, as indicated by the arrows R2 of FIG. 6, to pinch therebetween the excessive length of the wefts B extending out of the selvage C1. The so pinched excessive length of the wefts B are then cut by cutting means, such as a pair of scissors 6, and then carried away by the entangled yarns 310 and 4, as illustrated in FIG. 6.

As shown in FIG. 6, the cut wefts and the yarns 310 and 4 that are entangled together are fed through a winding member 7 which is continuously rotated by a transmission system of the loom 100 to more tightly entangle together to form a "rope" B1. The so formed rope B1 is then conducted away by an idle guide roller 71 to be collected at a collection station (not shown).

Preferably, the rear planetary gears 140 are so configured and disposed within the rear ring gear 111 that when the rear planetary gears 140 are rotated to be located in a first diameter of the rear ring gear 111 which is preferably a horizontal diameter of the rear ring gear 111 as viewed in FIG. 1 and which is the diameter passing through the centers of both the front and the rear holes 115 and 122, the arms 142 thereof "meet" or come across each other at the center of the rear ring gear 111, as shown in FIG. 2, and when the rear planetary gears 140 are rotated to be located in a second diameter of the rear ring gear 111, normal to the first diameter, which second diameter is preferably a vertical diameter of the rear ring gear, 111 as viewed in FIG. 1, the arms 142 thereof are respectively located at the topmost and lowermost positions of the rear ring gear 111.

preferably, the excessive length of each of the wefts B extend through between the two yarns 4 and 310 which have inter-wound with each other at a first location before the excessive length of the weft B by the rotations of the rear planetary gears 140 and the winding member 7. The yarns 4 and 310 are then inter-wound again at a second location after the excessive length of the weft B by the rotation of the rear planetary gears 140 so as to pinch the excessive length of the weft B between the yarns 4 and 310 to carry the excessive length of the weft B away. The cutting means 6 is preferably arranged to cut one of the wefts B when one of the wefts B is brought into between the two yarns 4 and 310 to be pinched thereby.

In accordance with another aspect of the present invention, there is provided yarn breaking detector means on the selvage forming and cord catching device 200 to detect the breaking of the yarns 310, 311, 4 and 5.

As shown in FIGS. 2, 3 and 5, the yarn breaking detector means comprises a bar member 141 pivotally supported in the proximity of each of the cylindrical yarn guide members 1320 and 1402 and biased by spring means 143. In the embodiment illustrated, the bar members 141 associated with the rear planetary gear system 400 are respectively pivoted to each of the rear planetary gears 140 and located between the cylindrical yarn guide members 1402 and the arms 1321. The bar members 141 associated with the front planetary gear system 300 are pivoted on the disk 133 and at locations close to the cylindrical yarn guide members 1320.

The bar members 141 have an eyelet 144 to allow the yarn 310 or 311 or 4 or 5 to extend therethrough. By the force balance between the biasing force provided the spring means 143 and the tension of the yarn, the bar member 141 will be rotated to a balanced position and maintained there if the tension of the yarn maintains. Once the yarn breaks, the tension disappears and the bar member 141 is no longer maintained at its balanced position.

To detect the rotation of the bar member 141, a magnet member 145 is attached to the bar member 141. A corresponding electro-magnetic sensor 50 is provided at a suitable position on the base 1 to sense the change of the position of the magnet member 145. Once the yarn breaks and the bar member 141 is moved by the spring means 143, the sensor 50 detects the change of the position of the magnet member 145 and thus provides a detection of the breaking of the yarn.

It is apparent that although the invention has been described in connection with the preferred embodiment, it is contemplated that those skilled in the art may make changes to the preferred embodiment without departing from the spirit and scope of the invention as defined in the appended claims.

What is claimed is:

1. A selvage forming and cord catching device for use in a loom in which a fabric having a selvage is woven with warps and wefts, said selvage forming and cord catching device comprising:

a base adapted to be secured on the loom having two gear seats formed thereon;

yarn supply means for supplying yarn to said loom;

a first planetary gear train comprising a sun gear rotatably supported in the first gear seat of the base and adapted to be in driving engagement with a motion transmission system of the loom to be driven thereby, a ring gear fixed on the base and two planetary gears driven by the sun gear and engaging the ring gear to orbit about a central axis of the sun gear by the rotation of the sun gear, each of the planetary gears comprising a concentrically-disposed cylindrical yarn guide member which defines a passage to allow said yarn supplied from said yarn supply means to pass therethrough and an eccentrically-mounted guide arm to which the yarn extending through the cylindrical yarn guide member is escorted to be fed therefrom to the loom so that when the planetary gears are rotated to orbit about the central axis of the sun gear, the yarns supplied from the cylindrical yarn guide members are fed to the loom in an inter-crossing and inter-winding manner by the escort of the eccentric guide arms to wind around each other; and a second planetary gear train comprising a sun gear rotatably supported in the second gear seat of the base and in driving engagement with the sun gear of the first planetary gear train to be driven thereby, a ring gear fixed on the base and two planetary gears driven by the sun gear and engaging the ring gear to orbit about a central axis of the sun gear by the rotation of the sun gear, each of the planetary gears comprising a concentrically-disposed cylindrical yarn guide member which defines a passage to allow said yarn supplied from said yarn supply means to pass therethrough and an eccentrically-mounted guide arm to which the yarn extending through the cylindrical yarn guide member is escorted to be fed therefrom to the loom so that when the planetary gears are rotated to orbit about the central axis of the sun gear, the yarn supplied from the cylindrical yarn guide members is fed to the loom in an inter-crossing and inter-winding manner by the escort of the eccentric guide arms to wind around each other for pinching therebetween an excessive length of the wefts to allow the excessive length of the wefts to be cut along the selvage by cutting means and carrying the cut wefts away.

2. A device as claimed in claim 1 wherein the first gear seat of the base comprises a circular recess receiving therein the sun gear of the first planetary gear train, a hole concentrically formed in the circular recess to receive a hub extending from a first surface of the sun gear with first bearing means disposed therebetween to rotatably support the sun gear inside the circular recess, the ring gear of the first planetary gear train comprising a ring-like projection fixed on the base, concentric with the circular recess, having teeth formed on an inner surface thereof, each of the planetary gears of the first planetary gear train comprising an axle extending therefrom to be rotatably mounted to a second surface of the sun gear, each of the cylindrical yarn guide members of the first planetary gear train includes a through hole extending through each of the axles to allow the yarn to extend from the first surface of the sun gear to be projected out of the planetary gears.

3. A device as claimed in claim 2 wherein the first bearing means is disposed between the hole of the first gear seat and the hub of the sun gear of the first planetary gear train and comprises an outer race formed on the periphery of the hole and an inner recess formed around the hub with a plurality of bearing balls disposed and retained therebetween.

4. A device as claimed in claim 2 wherein the ring-like projection is fixed around the first gear seat and comprises a circumferential slot which is adapted to receive a gear of the motion transmission system of the loom for partial extension therethrough to engage and drive the sun gear of the first planetary gear train.

5. A device as claimed in claim 2 wherein the second gear seat of the base comprises a circular recess for receiving therein the sun of the second planetary gear train, a slot being formed between the circular recesses of the first and second gear seats of the base to allow the sun gear of the second planetary gear train to partially extend therethrough to engage the sun gear of the first planetary gear train, a hole concentrically formed in the circular recess to receive a hub extending from a first surface of the sun gear with second bearing means disposed therebetween to rotatably support the sun gear inside the circular recess, a plurality of through holes being formed on the sun gear of the second planetary gear train, the second planetary gear train comprising a circular disk member concentrically connected to the sun gear thereof in a spaced manner, the ring gear of the second planetary gear train comprising a bottom defining therein a hole for rotatably receiving and retaining therein the disk member through third bearing means, each of the planetary gears of the second planetary gear train comprising an axle extending therefrom to be rotatably mounted to a surface of the disk facing away from the sun gear, each of the cylindrical yarn guide members of the second planetary gear train comprising a through hole extending through each of the axles to allow the yarns which extend through the through holes formed on the sun gear to extend from the disk member to project out of the planetary gears.

6. A device as claimed in claim 5 wherein the second bearing means disposed between the hole of the second gear seat and the hub of the sun gear of the second planetary gear train comprises an outer race formed on a periphery of the hole and an inner recess formed around the hub with a plurality of bearing balls disposed and retained therebetween.

7. A device as claimed in claim 5 wherein the third bearing means disposed between the hole of the ring gear of the second planetary gear train and the circular disk member comprises an outer race formed on a periphery of the hole and an inner recess formed around the disk member with a plurality of bearing balls disposed and retained therebetween.

8. A device as claimed in claim 1 further comprising yarn breaking detector means mounted adjacent each of the cylindrical yarn guide members of both the first and second planetary gear trains to detect a yarn break, said detector means comprising a spring-biased bar member pivotally mounted in association with each of the cylindrical yarn guide members, the bar member having an eyelet to allow the yarn to extend therethrough for rotating the bar member to a force balanced position by the spring biasing force and tension of the yarn, a magnet member is attached to the bar member and associated with an electromagnetic sensor which monitors change of location of the magnet member to detect the breaking of the yarn.

9. A device as claimed in claim 1 wherein said yarn supply means comprises a frame fixed to each of the sun gears, a yarn reel support member is rotatably mounted to the frame to rotatably support thereon a yarn reel of substantial weight on which a yarn is wound so that when the sun gear is rotated, said yarn reel is substantially maintained stationary, said yarn supply means further comprising a fixed yarn bobbin on which a second yarn is wound, said second yarn extending from said fixed yarn bobbin to said frame to be escorted by a yarn guide arm fixed on said frame.

* * * * *